US007111752B2

(12) United States Patent
Bucher et al.

(10) Patent No.: US 7,111,752 B2
(45) Date of Patent: Sep. 26, 2006

(54) CONTAINER AND METHOD OF MAKING SAME

(75) Inventors: Hubert Bucher, Deggenhauser Tal (DE); Albert Fritzsche, Markdorf (DE)

(73) Assignee: EADS Deutschland GmbH, Ottobrunn (DE)

( * ) Notice: Subject to any disclaimer, the term of this patent is extended or adjusted under 35 U.S.C. 154(b) by 478 days.

(21) Appl. No.: 10/457,001

(22) Filed: Jun. 9, 2003

(65) Prior Publication Data

US 2004/0031794 A1 Feb. 19, 2004

(30) Foreign Application Priority Data

Jun. 7, 2002 (DE) ..... 102 25 281

(51) Int. Cl.

| | |
|---|---|
| ***F25D 23/00*** | (2006.01) |
| ***B65D 1/42*** | (2006.01) |
| ***B65D 6/34*** | (2006.01) |
| ***B65D 8/08*** | (2006.01) |

(52) U.S. Cl. ..... 220/592.2; 220/645

(58) Field of Classification Search ..... 220/4.31, 220/218, 567.2, 586, 592.2, 592.25, 592.26, 220/645, 651; 52/379, 383, 395.05, 787.1, 52/787.12, 794.1, 800.11, 800.12; 312/400, 312/406.2, 409; 211/59.3, 184; 135/116, 135/120.3

See application file for complete search history.

(56) References Cited

U.S. PATENT DOCUMENTS

| | | | | |
|---|---|---|---|---|
| 3,484,999 A | | 12/1969 | Van Der Lely | 52/79 |
| 3,573,144 A | | 3/1971 | Andersen | 161/38 |
| 3,975,878 A | | 8/1976 | Modarelli, Jr. | 52/285 |
| 5,450,977 A | * | 9/1995 | Moe | 220/592.09 |
| 5,732,839 A | | 3/1998 | Schimmang et al. | 220/1.5 |
| 6,065,264 A | * | 5/2000 | Imler et al. | 52/589.1 |
| 6,138,580 A | | 10/2000 | Thoman | 105/396 |
| 6,367,391 B1 | | 4/2002 | Thoman et al. | 105/404 |
| 6,860,082 B1 | * | 3/2005 | Yamamoto et al. | 52/794.1 |

FOREIGN PATENT DOCUMENTS

| | | | |
|---|---|---|---|
| DE | 37 19 301 | | 12/1988 |
| DE | G 92 00 602.7 | | 5/1992 |
| DE | G 92 16 314.9 | | 3/1993 |
| DE | 297 00 436 | | 9/1997 |
| DE | 201 01 947 U1 | | 5/2001 |
| EP | 0 682 156 | | 5/1995 |
| FR | 2 393 118 | | 12/1978 |
| JP | 11343698 A | * | 12/1999 |

OTHER PUBLICATIONS

Machine translation of JP 11-343698 A.*

* cited by examiner

*Primary Examiner*—Nathan J. Newhouse
*Assistant Examiner*—Harry Grosso
(74) *Attorney, Agent, or Firm*—Crowell & Moring LLP

(57) ABSTRACT

A container that is used as a mobile workspace for both civilian and military applications. At least one flat-shaped structural element of the container, e.g., the interior or the exterior wall, the floor or the ceiling, includes surface layers with sandwiched insulation material, and rib-shaped spacers between the two surface layers. According to the invention, the two surface layers, as well as the rib-shaped spacers, may consist of fiber-reinforced plastic material, and the rib-shaped spacers hold a metal profile.

10 Claims, 1 Drawing Sheet

CONTAINER AND METHOD OF MAKING SAME

BACKGROUND AND SUMMARY OF THE INVENTION

This application claims the priority of German Application No. 102 25 281.5-22 filed Jun. 7, 2002, the disclosure of which is expressly incorporated by reference herein.

The invention concerns a container. Preferred embodiments of the invention relate to containers in compliance with ISO standards and preferably serving as a mobile workspace for both civilian and military applications and having at least one flat-shaped container element which is formed of surface layers, sandwiched insulation material, and rib shaped spacers between the surface layers.

The increasing necessity for mobile container systems (particularly rescue stations, field hospitals or command posts) with sophisticated equipment necessitates lighter-weight containers for the benefit of their interior equipment, without loss of thermal insulation, structural rigidity and certain equipment versatility.

ISO standard containers of this type are, for example, cuboid in form, are described in German Patent Document DE 37 19 301 C2. Other containers are known, e.g., from European Patent Document EP 0 682 156 B1 (corresponding U.S. Pat. No. 5,732,839) or German Patent Document DE G 92 16 314.9 U1, which consist of a basic container and movable structural elements (flaps and/or slide-outs) to increase volume.

German Patent Document DE 297 00 436 U1 discloses a large volume container wall structure that consists of an interior and an exterior plastic layer, which sandwich foam. The interior layer is made of a transparent plastic material, forming a see-through strip that extends in a vertical direction and across the entire depth of the wall structure.

German Patent Document DE 92 00 602 U1 discloses plastic lining for containers, tubs, etc. that is fastened by metal profiles on the surface being lined.

Spacers are provided between the lining and the surface being lined.

Container stackability is a significant dimensioning criterion, while the basic container in expandable containers is the major contributor to rigidity. The wall structure of conventional containers is characterized by metal surface layers, which are connected by metal spacers. The clearance between the two opposite surface layers is filled with insulation material (inserted or bonded), resulting in sufficient rigidity, as well as thermal insulation. An additional wall-reinforcing layer and more offset, countersunk metal profiles facilitate the fastening of heavy equipment to both the floor and the vertical walls of the container interior.

It is an object of this invention to reduce container self-weight, while maintaining the above-mentioned mechanical and thermal properties.

This object is achieved according to certain preferred embodiments of the invention by providing a container with or without movable structural elements to increase volume, and preferably serving as mobile workspace for both civilian and military applications, with a minimum of one flat-shaped structural container element in the form of an interior or exterior wall, a floor or a ceiling wherein the structural container element comprises two surface layers, sandwiched insulation material between the surface layers, and rib-shaped spacers between the two surface layers, and wherein the two surface layers and the rib-shaped spacers are made of plastic, and the rib-shaped spacers hold a metal profile. Advantageous designs of the invention are described herein and in the claims.

According to preferred embodiments of the invention, both container wall surface layers, as well as the rib-shaped spacers, are made of plastic material. The spacers hold a metal profile.

The rib-shaped spacer ends are rigidly connected to the two surface layers and primarily serve to ensure structural rigidity. The wall structure comprises a number of directly adjacent chambers, the periphery of which is formed by the spacers and the surface layers. The chambers are filled with insulation material.

In certain preferred embodiments of the invention, the rib-shaped spacers are advantageously arranged toward the exterior side of the container in the form of a single crosspiece (one arm in cross-section), which graduates into a two-armed spacer cross-section toward the interior side of the container. The above-mentioned metal profile is located between the two arms, preferably with a positive fit.

As a preferred design according to certain preferred embodiments of the invention, the rib-shaped spacer exhibits a T-shaped cross-section toward the exterior side of the container, graduating into a U-shaped cross-section toward the interior side of the container.

The described cross-section shapes result in relatively long heat transfer paths between interior and exterior surface layers, thereby generally improving thermal insulation.

The metal profiles located in the spacers serve to accommodate the load application for the equipment that will be installed on the interior wall of the container, e.g., built-in closets, tools/instruments, etc.).

In an advantageous design, the two surface layers and/or the rib-shaped spacers may be made of fiber-reinforced plastic material.

The invented structure is particularly suitable for those structural container elements that are not subjected to extreme mechanical stress. It is especially beneficial for slide-outs or flaps of expandable containers, and also for interior walls or flooring of non-expandable containers. Excellent strength can be achieved by means of adding fiberglass, carbon or Kevlar® fiber to plastics with a density of between 1 and 1.5 kg/dm$^3$ (13% to 20% of the density of steel, 37% to 55% of that of aluminum). Thermal conductivity of plastics is approximately 1% of that of steel or stainless steel.

Even though the material thickness of ribs and profiles extending in heat-flow direction is required to be greater than in the case of steel, the significant benefit of reduced negative influence of thermal bridges remains.

For the purpose of structural rigidity, a further advantageous variant provides an additional intermediate plastic layer between the two surface layers.

The chamber-type cavities between neighboring spacers and the two surface layers may be filled with vacuum insulation material, preferably in the form of panels. This is advantageous, as it means extremely low thermal conductivity. Application of already known vacuum insulation technology reduces the weight and volume of insulation material and wall thickness, and increases the useful volume at a predetermined heat transition coefficient. In certain preferred embodiments of the invention granular or fibrous filling material, combined with getter material and an IR opacifier as necessary or desired, is impermeably enclosed by a multi-layer composite film (metal foil and, e.g., polyethylene or polyester foil). At a heat transition coefficient of between 0.0035 W/(mK) and 0.0045 W/(mK), the combination of a system pressure of less than 5 mb, impervious heat-sealing of the foil and a negligible permeation rate, warrants a durability of over 15 years. The vacuum insulation panel dimensions ranging from 10 mm to 30 mm in thickness may be adjusted to the geometric configuration requirements. The heat transition coefficient values of conventional insulation material, e.g., polyurethane foam or mineral wool/fiberglass, are approximately 0.035 to 0.045 W/(mK).

Wall fabrication by bonding the extruded spacers and the intermediate layer, if applicable, and inserting and/or bonding the insulation material, constitutes the simplest production method. For mass production, advanced, automated production processes are feasible. In the event of electromagnetic compatibility (EMC) requirements, suitable grids may be provided as part of the wall structure.

The butt joint of two panels according to the invention may be performed by bonding, riveting or screwing, and may be expediently reinforced with metal or plastic corner profiles outside and/or inside.

Applications of the invented lightweight structure, which may be produced in diverse wall thickness, include walls for movable structural elements in expandable containers, walls for low-load, non-expandable containers, and interior walls/partitions of any kind. In smaller dimensions, this structure is also suitable for floor panels in tents. Medical stations, for instance, require safe walking, thermal insulation and easy cleaning. These requirements are not met by using a tarpaulin spread out on the ground.

The container wall structure according to the invention reduces the weight, without limiting the versatility of the container with regard to interior finishing (particularly equipment installation).

Other objects, advantages and novel features of the present invention will become apparent from the following detailed description of the invention when considered in conjunction with the accompanying drawings.

DETAILED DESCRIPTION OF THE DRAWINGS

Figure 1:
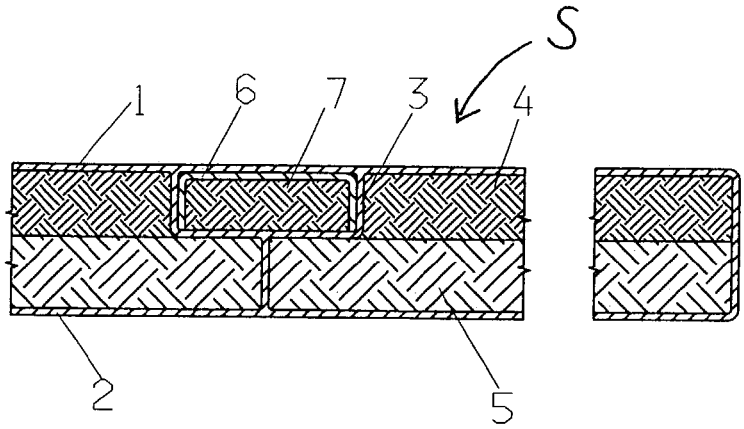
FIG. 1 is a cross-sectional view of a lightweight wall section of a container constructed according to a preferred embodiment of the invention, and showing rib-shaped plastic spacers and inserted metal profiles.
Figure 2:
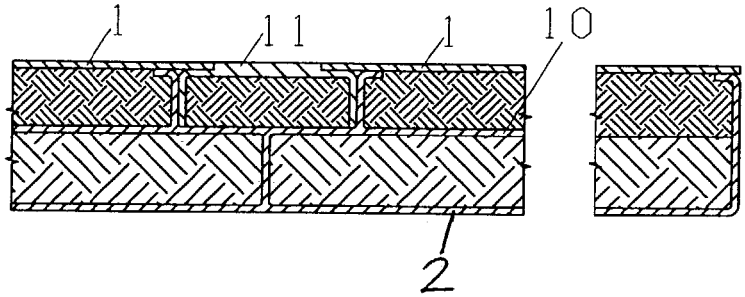
FIG. 2 is a cross-sectional view of a lightweight wall section of a container constructed according to a preferred embodiment of the invention, with a surface layer that is bonded in sections.
Figure 3:
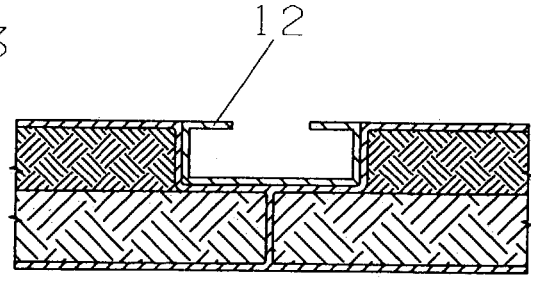
FIG. 3 is a similar cross-sectional view as FIG. 1 and FIG. 2 showing another preferred embodiment of the invention, with a metal profile that is formed as a C-shaped crosspiece.

Preliminary remark: In FIGS. 1 through 3, the upper side of the container wall is directed toward the interior,of the container, while the lower side of the container is directed to the outside container environment.

FIG. 1 is a cross-sectional view of a container lightweight wall S according to the invention. An in-situ view of the lightweight wall S of FIG. 1 in a container C is shown in FIG. 5. The two plastic surface layers 1, 2 and a plastic rib-shaped spacer 3 located between the two surface layers can be seen. The spacer 3 (in the following also referred to as the crosspiece), which is rigidly connected at its ends to the surface layers 1, 2, primarily serves to ensure structural rigidity. The lower part of the spacer shows a T-shaped cross-section; upwardly, it graduates into a U shape. Overall, the lightweight structure S demonstrates a chamber-type structure consisting of individual adjoining chambers, which are filled with insulation material.

In the upper U-shaped part of the spacer 3, a metal profile 6, which extends parallel of the surface layers 1, 2, is inserted. Since metal profile 6 is enclosed in a form fit by the surface layer 1 and the spacer 3, it can be inserted without additional attaching, e.g., bonding. The cavity 7, which is enclosed by the metal profile 6, should also be filled with insulation material. The metal profile primarily serves the load application of the equipment that will be installed on the interior wall of the container.

In the illustrated design of FIG. 1, insulation material is provided in two layers 4, 5. As an advantageous aspect, the exterior insulation layer 5 consists of vacuum insulation material. The upper insulation layer 4, extending toward the inside of the container, may also consist of vacuum insulation material. Optionally, other conventional insulation material, such as mineral or rock wool, may also be used.

The thickness of the interior surface layer 1 and the exterior surface layer 2, material thickness, and the horizontal distance and height (wall thickness) of the crosspiece 3, determine wall rigidity. The choice of insulation material 4, 5 and their thickness determine thermal insulation quality. The dimensions of the inserted metal profile 6 will be established based on load requirements, overall wall rigidity, and equipment installed on the walls and on the floor.

Compared to FIG. 1, the structure variant shown in FIG. 2 provides an additional plastic reinforcement layer 10 located inside the wall. The inserted metal profile 11 protrudes from the layer 1 in such manner that it forms part of the level surface of the wall S that extends toward the inside of the container. Layer 1 therefore consists of several sections that are bonded individually between the metal profiles 11.

FIG. 3 demonstrates a variant of the metal profile in the form of a so-called C-rail 12, which is open in the direction toward the inside of the container. With this arrangement, loads can be attached with suitable fastening means without drilling.

Figure 4:
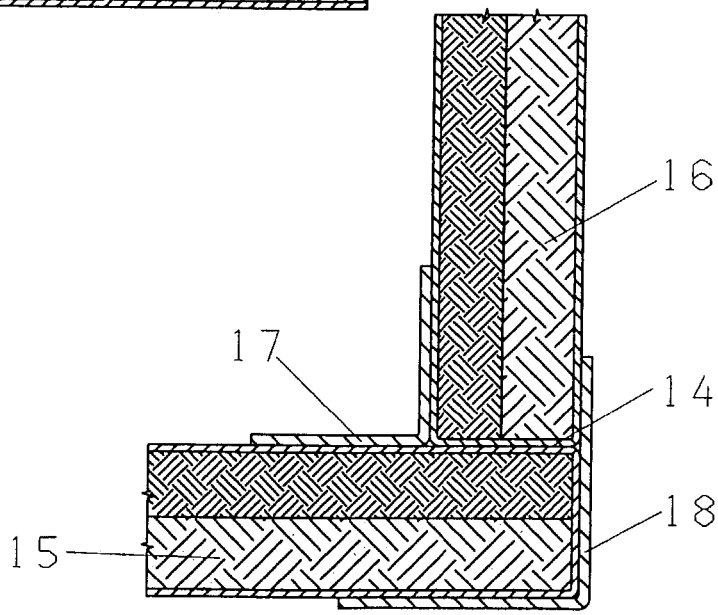
FIG. 4 is a schematic sectional view of the rectangular connection of two lightweight walls according to preferred embodiments of the invention, in a container with reinforced corners, inside and outside.

The bonded butt joint 14 (FIG. 4) of two rectangular walls 15, 16 of a structure, according to the invention, is reinforced with an L-profile 17 located inside, and an L-profile 18, located outside. A room corner, i.e., the butt joint of three walls, is completely covered either by a rounded molding piece (rounded corner), or by three beveled L-profiles. An in-situ view of the bonded butt joint 14 of FIG. 4 in a container C is shown in FIG. 5.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Container with or without movable structural elements to increase volume, and preferably serving as mobile workspace for both civilian and military applications, with a minimum of one flat-shaped structural container element, in the form of an interior or exterior wall, a floor or a ceiling, wherein the structural container element includes: two surface layers, sandwiched insulation material between the surface layers, and rib-shaped spacers between the two surface layers, the two surface layers and the rib-shaped spacers are made of plastic, and the rib-shaped spacers hold a metal profile, and the rib-shaped spacers extending toward an exterior side of the container are in the form of a crosspiece, which, toward an interior side of the container, graduates into a two-armed spacer cross-section, while the spacers hold the metal profile inside those two arms.

2. Container with or without movable structural elements to increase volume, and preferably serving as mobile workspace for both civilian and military applications, with a minimum of one flat-shaped structural container element, in the form of an interior or exterior wall, a floor or a ceiling, wherein the structural container element includes: two surface layers, sandwiched insulation material between the surface layers, and rib-shaped spacers between the two surface layers, the two surface layers and the rib-shaped spacers are made of plastic, and the rib-shaped spacers hold a metal profile, and rib-shaped spacers exhibit a T-shaped cross-section toward an exterior side of the container, graduating into a U-shaped cross-section toward an interior side of the container, while the spacers hold the metal profile inside their U-shaped section.

3. Container according to claim 1, wherein the insulation material includes two insulation layers, at least one insulation layer consisting of vacuum insulation material.

4. Container according to claim 2, wherein the insulation material includes two insulation layers, at least one insulation layer consisting of vacuum insulation material.

5. Container according to claim 1, wherein the metal profile exhibits a form of a C-rail, which opens in a direction toward an outer surface of the structural element.

6. Container according to claim 2, wherein the metal profile exhibits a form of a C-rail, which opens in a direction toward an outer surface of the structural element.

7. Container according to claim 1, wherein one side of the metal profile ends flush with one of the two surface layers, together forming part of the surface of the structural element.

8. Container according to claim 2, wherein one side of the metal profile ends flush with one of the two surface layers, together forming part of the surface of the structural element.

9. Container according to claim 1, wherein an additional plastic layer is sandwiched between the two surface layers.

10. Container according to claim 2, wherein an additional plastic layer is sandwiched between the two surface layers.

* * * * *